US006797191B2

(12) United States Patent
Philips et al.

(10) Patent No.: US 6,797,191 B2
(45) Date of Patent: Sep. 28, 2004

(54) EFFICIENT SNOWMAKING WITH POLYMER DRAG REDUCTION

(75) Inventors: Richard B. Philips, Barrington, RI (US); Theresa A. Baus, Warren, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 166 days.

(21) Appl. No.: 10/090,987

(22) Filed: Feb. 28, 2002

(65) Prior Publication Data

US 2003/0162865 A1 Aug. 28, 2003

(51) Int. Cl.[7] ..... C09K 3/00

(52) U.S. Cl. ..... 252/1; 62/66; 62/68; 62/74; 239/2.2

(58) Field of Search ..... 252/1; 62/66, 68, 62/74; 239/2.2

(56) References Cited

U.S. PATENT DOCUMENTS 3,265,650 A * 8/1966 Kerr ..... 524/322
5,660,935 A * 8/1997 Kambayashi et al. ..... 428/405
5,886,083 A * 3/1999 Mackey ..... 524/503
6,116,515 A * 9/2000 Chelminski ..... 239/2.2
6,464,148 B1 * 10/2002 Costa et al. ..... 239/2.2
6,466,870 B2 * 10/2002 Satonaka ..... 701/213

* cited by examiner

*Primary Examiner*—Cephia D. Toomer
(74) *Attorney, Agent, or Firm*—James M. Kasischke; Michael F. Oglo; Jean-Paul A. Nasser

(57) ABSTRACT

A method for reducing the drag on an aqueous solution in a pipe or hose system such as a snow making system includes the introduction of drag reducing polymers into the aqueous solution prior to circulating the solution in a pipe or hose. In a preferred embodiment, the drag reducing polymers are a mixture of polyethylene oxide in a carrier solution. The introduction of the polyethylene oxide in a carrier solution reduces the overall frictional drag and therefore increases the snow making efficiency by reducing the power needed to pump the water. As a result, it is easier for greater quantities of snow to be made using existing equipment due to the increased flow rate as a result of the lower drag friction. In a preferred embodiment, the polyethylene oxide is approximately 20–30% by weight and is introduced into the water pipe so resulting concentrations are approximately 30–100 weight parts per million (WPPM).

8 Claims, 2 Drawing Sheets

EFFICIENT SNOWMAKING WITH POLYMER DRAG REDUCTION

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

Not applicable.

BACKGROUND OF THE INVENTION (1) Field of the Invention

The present invention relates to a method for producing man-made snow and apparatus therefore, and more particularly, to a method for improving the performance of snow making equipment by reducing frictional drag.

(2) Description of the Prior Art

Recreational skiing has been on the increase over the years to the point where ski areas must make snow to supplement natural snow, because in many area of the world not enough natural snow falls to satisfy the demand for good skiing conditions. In recent years, indoor skiing facilities have enjoyed construction everywhere. Consequently, there is a need to produce large amounts of artificial snow.

To produce large amounts of artificial snow, a large amount of energy is used to supply the many pumps that are necessary to transfer the water needed to make the snow. Furthermore, large pipes and hoses are required to transport the water making it difficult to set up and move the snow making equipment. In consideration of the large amounts of energy consumed by the pumps, it is important to increase the efficiency of snow making and reduce the energy required to make an amount of snow.

Known methods of increasing snow making efficiency have generally focused on increasing the recreational efficiency of the actual snow produced. Many of these methods involve the introduction of nucleating materials such as cellulose and various polymers. While these methods are successful at reducing the quantity of snow necessary, they do not address the large amounts of energy required to actually make the snow.

SUMMARY OF THE INVENTION

A first object of this invention is to provide a method for increasing efficiency in a snowmaking system.

Another object is providing snowmaking system having reduced drag and greater efficiency.

Yet another object of this invention is to allow greater dispersal of artificial snow by providing increased muzzle velocity at the snow making nozzle.

Accordingly, embodiment of the present invention is a method for making artificial snow comprising the steps of mixing water with a drag reducing polymer to form an aqueous solution; aerating the aqueous solution; and freezing the aerated aqueous solution to form snow crystals. In a preferred embodiment, the drag reducing polymer comprises polyethylene oxide in a carrier solution wherein the carrier solution includes glycerin and isopropanol.

In another embodiment, the drag reducing polymer includes polyethylene oxide particles having a diameter less than about 20 microns. Preferably, the concentration of the polyethylene oxide in the carrier solution is about 20 to about 30 percent by weight and the concentration of the drag reducing polymer in the water is approximately about 30 to about 100 weight parts per million (WPPM).

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
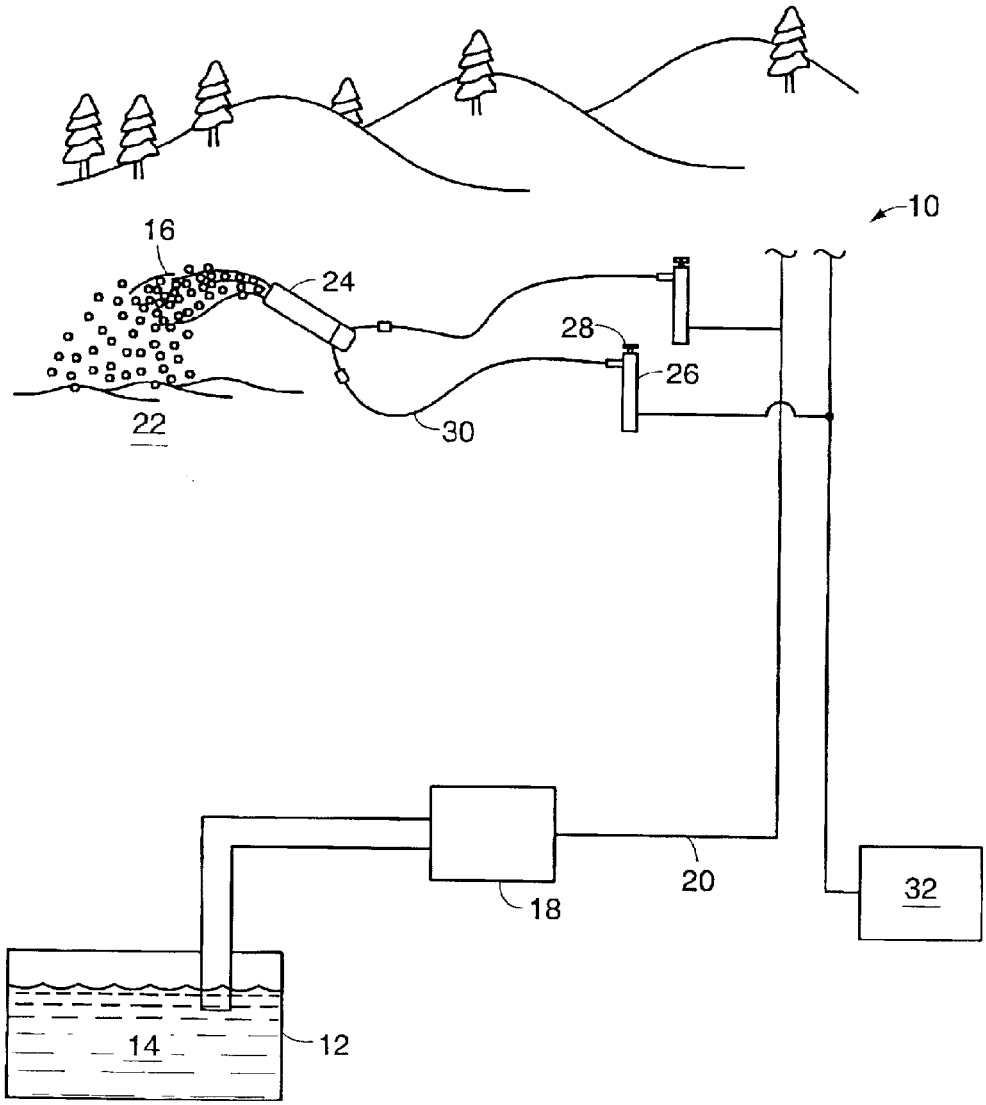
FIG. 1 PRIOR ART
FIG. 1 is a schematic view of prior art snowmaking process.

In the practice of snow making 10, FIG. 1, a water supply 12, such as a stream, pond, or tank is required for providing a large supply of water 14 needed for the production of large quantities of artificial snow 16. A pump 18 is used to draw the water 14 from the water supply 12, and transport the water 14 up the mountain through suitable piping 20, to the location 22 where the snow 16 is to be made. A snow gun 24 is positioned, pointing in the direction that the snow 16 is to be placed. Water 14 being transported up the hill, through piping 20, can be directed to the snow gun by the use of various branch lines coming from various T's in the water pipe 20. In many snow making operations, the snow guns 24 are connected to hydrants 26 having valves 28 using flexible rubber hoses 30. Compressed air 32 is also commonly employed, however, a fan type of gun (not shown) may also be used.

In nearly all snow making operations, a large amount of piping 20 is required because the water supply 12 is far away from the location 22 where the snow 16 is to be made. The large amount of piping 20 introduces a large amount of frictional drag for the pump 18 to overcome. Consequently, large pumps 18 are required which utilize large amounts of energy to operate.

Figure 2:
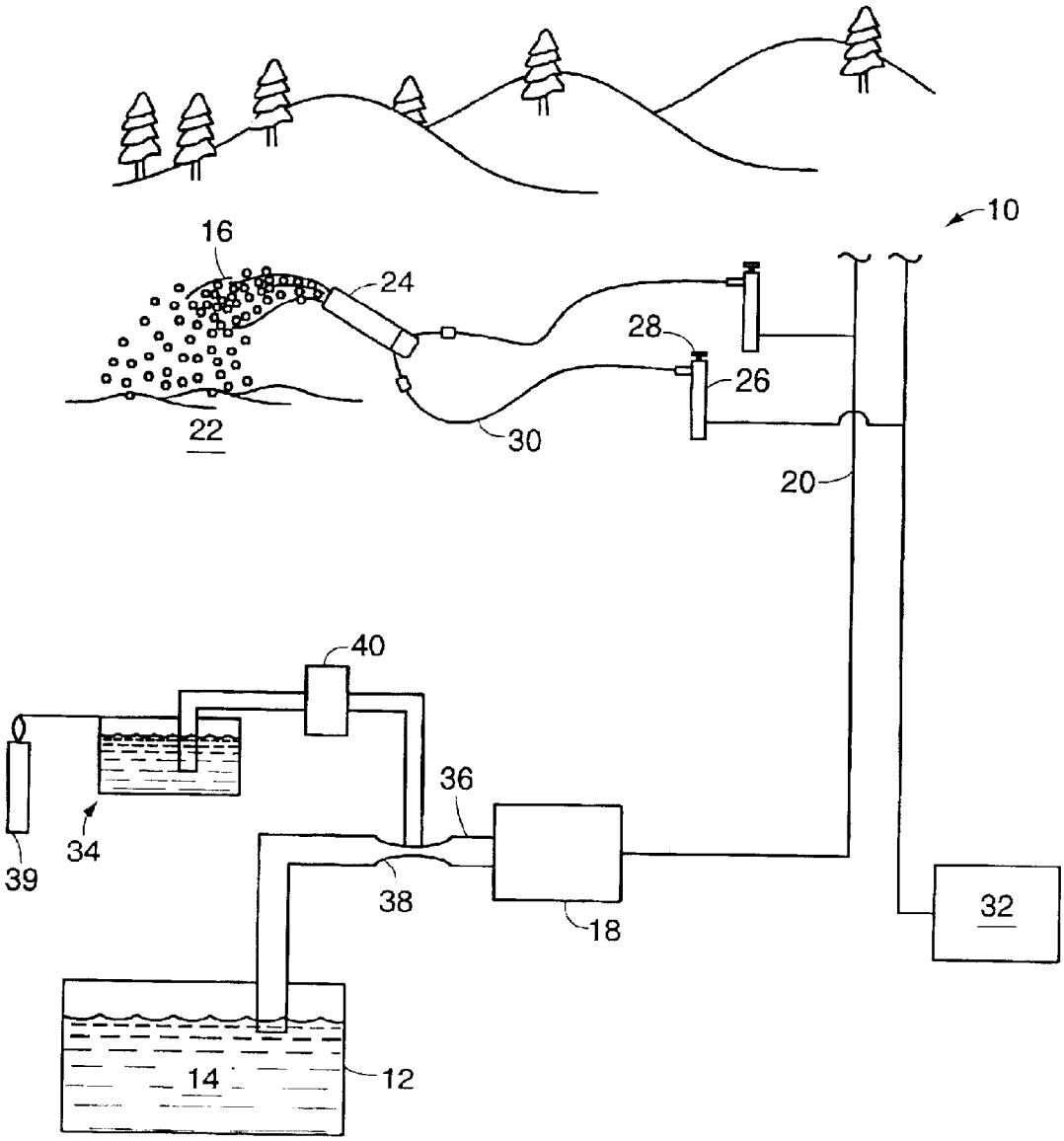
FIG. 2 is a schematic view of one embodiment of the present invention.

The present invention includes drag reducing polymers 34, FIG. 2, introduced into the water 14 to reduce the frictional drag needed to be overcome by the pump 18, thus reducing the amount of energy required to produce artificial snow 16. The drag reducing polymers 34 reduce the frictional drag of the water 14 as it flows through the piping 20 thus allowing more water 14 to be pumped to the snow maker snow gun 24 or to use smaller diameter piping 20 and/or flexible rubber hoses 30 to produce the same quantity of snow 16. A greater volume of snow can be generated with the same diameter of piping.

The drag reducing polymers 34 of the present invention can be used with any snow making process and is not limited to those described above or below. The drag reducing polymers 34 may also be used in combination with other snow making additives 35 for example, but not limited to, nucleating particles. Furthermore, the drag reducing polymers 34 may be used in any system wherein water 14 is pumped over large distances, for example, but not limited to, manufacturing processes and heat exchangers.

In one embodiment, the drag reducing polymers 34 include small particles of polyethylene oxide suspended in a carrier solution, such as glycerin and isopropanol, at concentrations of approximately 20–30% by weight of the total. According to a preferred embodiment, the polyethylene oxide particles are smaller than 20 microns although larger particles will also work.

In a preferred embodiment, the drag reducing polymers 34 are placed near the inner wall 36 of the water pipe 20 to further reduce the frictional drag. The drag reducing polymers 34 may be introduced into the water 14 using a venturi 38 or a pump 40. Preferably, the drag reducing polymers 34 are introduced into the pipe 20 so that the resulting concentration of the polymer in the water is approximately 30–100 weight parts per million (wppm).

In a further preferred embodiment, the drag reducing polymers 34 are introduced into the water 14 as close to the water source 12 as possible. Introducing the drag reducing polymers 34 near the water source 12 maximizes the reduction of frictional drag.

According to another embodiment, compressed air 39 is introduced above the polyethylene oxide in place of the pump 40. This is an air over fluid system. The addition of the drag reducing polymers 34 into the water 14 not only reduces the frictional drag required to be overcome by the pump 18, but also makes it easier for personnel to set up the snow making equipment 24 since the flexible rubber hoses 30 required can be smaller in size and easier to manage.

Furthermore, the muzzle velocity of the snow 16 out of the gun 24 is increased, allowing the snow 16 to be blown over a greater area.

In light of the above, it is therefore understood that within the scope of the appended claims, the invention may be practiced otherwise than as specifically described.

What is claimed is:

1. A method for making artificial snow comprising the steps of:

mixing water with a drag reducing polymer to form an aqueous solution, wherein said drag reducing polymer solution comprises polyethylene oxide in a carrier solution;

aerating said aqueous solution; and freezing said aerated aqueous solution to form snow crystals.

2. The method as claimed in claim 1 wherein said carrier solution includes glycerin and isopropanol.

3. A method for making artificial snow comprising the steps of:

mixing water with a drag reducing polymer to form an aqueous solution, wherein said drag reducing polymer includes polyethylene oxide particles having a diameter less than about 20 microns;

aerating said aqueous solution; and freezing said aerated aqueous solution to form snow crystals.

4. The method as claimed in claim 3 wherein the concentration of said polyethylene oxide in said aqueous solution is about 20 to about 30 percent by weight.

5. A snow making system comprising:

a water source;

a drag reducing polymer source wherein said drag reducing polymer comprises polyethylene oxide in a carrier solution;

mixing means joined to said water source and said drag reducing polymer source for mixing said polymer in said water;

a pump joined to said mixing means;

a fluid transfer line joined to said pump; and a snow making nozzle joined to said fluid transfer line.

6. The snow making system as claimed in claim 5 wherein said carrier solution includes glycerin and isopropanol.

7. The snow making system as claimed in claim 5 wherein said polyethylene oxide has a particle diameter less than 20 micros.

8. The snow making system as claimed in claim 5 wherein said polyethylene oxide in said carrier solution is an a concentration of 20 to 30 percent by weight.

* * * * *